US006904828B2

(12) United States Patent
Kane

(10) Patent No.: US 6,904,828 B2
(45) Date of Patent: Jun. 14, 2005

(54) CORKSCREW

(76) Inventor: Stephen Kane, 9 Four Seasons Drive, Roselevan, Ennis, County Clare (IE)

( * ) Notice: Subject to any disclaimer, the term of this patent is extended or adjusted under 35 U.S.C. 154(b) by 43 days.

(21) Appl. No.: 10/221,196

(22) PCT Filed: Mar. 22, 2001

(86) PCT No.: PCT/IE01/00037

§ 371 (c)(1),
(2), (4) Date: Dec. 11, 2002

(87) PCT Pub. No.: WO01/70620

PCT Pub. Date: Sep. 27, 2001

(65) Prior Publication Data

US 2003/0177869 A1 Sep. 25, 2003

(30) Foreign Application Priority Data

Mar. 22, 2000 (IE) ..... S2000/0220

(51) Int. Cl.[7] ..... B67B 7/00
(52) U.S. Cl. ..... 81/3.25; 81/3.32; 81/3.29
(58) Field of Search ..... 81/3.25, 3.31, 81/3.32, 3.29, 3.39

(56) References Cited

U.S. PATENT DOCUMENTS 4,295,392 A 10/1981 Peck

FOREIGN PATENT DOCUMENTS

| | | |
|---|---|---|
| DE | 39689 | 11/1986 |
| FR | 2318103 | 2/1977 |

*Primary Examiner*—James G. Smith
(74) *Attorney, Agent, or Firm*—Jacobson Holman PLLC

(57) ABSTRACT

A corkscrew assembly (50) has a tubular body (52) mounted on an upright slide bar (75) by means of a collar (72) which is connected to the body (52) by an arm (73). The slide bar (75) is carried by pillars (76) on a base plate (77) which in use is attached to a wall or the like above a horizontal work surface. The collar (72) can be moved up or down on the slide bar (75) for height adjustment of the body (52) to engage a mouth (85) at a lower end of the body (52) with the neck of a bottle placed on the work surface below the body (52). Locking means is provided on the collar (72) to releasably lock the collar (72) on the slide bar (75) when engaged with a bottle to securely hold the bottle for cork extraction. An actuating lever arm (68) on the body (52) can then be moved downwardly from a raised position to operate drive means on the body (52) to screw a corkscrew (57) into the cork of the bottle. When subsequently raised, the lever arm (68) initially extracts the cork from the bottle and engages the cork against an inner end (91) of a cork receiving chamber (90) in the body (52) when the lever arm (68) is partially raised. As the lever arm (68) is moved further upwards, the drive for the corkscrew (57) is reversed to disengage the cork from the corkscrew (57).

18 Claims, 9 Drawing Sheets

CORKSCREW

This is a nationalization of PCT/IE01/00037 filed Mar. 22, 2001 and published in English.

BACKGROUND OF THE INVENTION

1. Field of the Invention

The present invention relates to a construction of corkscrew and in particular to a construction of corkscrew where a large number of wine bottles have to be opened over relevantly short periods of time such as in restaurants and other similar establishments.

2. Description of the Prior Art

There are many types of corkscrew some of which are more useful than others. There are a number of principal requirements from any corkscrew namely the screw must start out perpendicular to the centre of the cork and the cork should come out cleanly, slowly and easily out of the bottle.

Uncorking machines suffer from the limitation where if they are bench mounted considerable force has to be exerted to push the bottle against the screw, and to hold the bottle while extracting the cork. This problem also occurs when operating wall mounted uncorking machine.

While some corkscrews work relatively efficiently, they suffer from the disadvantage that in general they need to be held on a flat surface or they are gripped by the person using the corkscrew. Unfortunately as the corkscrew is inserted into the neck of the bottle and into the cork it is not unknown for the bottle to slip and to spill. In a situation where there is a large number of bottles to be opened what would be ideal would be if there was one station where the corkscrew can be placed and the bottles can be easily opened at that station. The present invention is directed at providing such a corkscrew.

It is an object of the invention to provide a corkscrew which has all the advantages of a conventional corkscrew with the additional advantage of being able to retain the bottle in a fixed rigid position during the extraction of the cork.

It is a further object of the invention to provide a corkscrew which is able to accommodate many sizes of bottles which can vary in height or neck diameter.

SUMMARY OF THE INVENTION

According to the invention there is provided a corkscrew assembly comprising:

a body;

a support for the body which is height adjustable relative to a work surface;

a spirally wound worm screw rotationally mounted within the body; and means to rotate the spirally wound worm screw.

In one embodiment of the invention, the support comprises a slide rail with an associated carriage which is slidable along the rail, the carriage being connected to the body.

In one embodiment, there is provided means for releasably locking the carriage on the slide rail.

In another embodiment, the locking means comprises a brake element mounted on the carriage for engagement with the slide rail, with actuating means to move the brake element between a released inoperative position and an engaged operative braking position.

In a further embodiment, the actuating means is a lever arm which, when in a fully raised position, releases the brake element and when moved downwardly away from the fully raised position, engages the brake element for locking the carriage on the slide rail.

In another embodiment, the brake element is slidably mounted on the carriage and has an inner end for engagement with the slide rail and an outer end which is engageable by an associated cam on the lever arm to urge the brake element against the slide rail in the engaged position.

In a further embodiment, the brake element comprises a friction plug mounted in a bore on the carriage, a cam follower rod slidably mounted in the bore outboard of the friction plug and having an outer end which projects outwardly of the bore for engagement with the cam on the lever arm.

In another embodiment, a pair of brake elements are provided on the carriage for clamping the slide rail therebetween in response to operation of the actuating means.

In a further embodiment, the brake element comprises a locking washer mounted on the carriage and having a central through hole for through passage of the slide rail, a periphery of the washer hingedly engaging the carriage at one side of the washer.

In another embodiment, the carriage is a loose sliding fit on the slide rail.

In a further embodiment, the slide rail is of circular section and the carriage comprises a collar having a central through hole for sliding engagement with the rail.

In another embodiment, the corkscrew comprises a spirally wound worm screw.

In a preferred embodiment, the worm screw is rotatably mounted on a slide block for rotation about a longitudinal axis of the worm screw, the slide block being slidably mounted on the body for vertical movement, the worm screw engaging a complementary threaded guide mounted on the body and being movable through the threaded guide for rotation of the worm screw.

In a particularly preferred embodiment, the threaded guide is slidably mounted on the body for movement along a shorter path than the slide block carrying the worm screw.

In another embodiment, the means for rotating the worm screw comprises a bifurcated lever arm having an inner end which is rotatably mounted on the boss, the lever arm being connected intermediate its ends to the slide block carrying the worm screw.

In a further embodiment, the body is of tubular construction, the slide block being slidable within a bore of the body and the lever arm is connected to the slide block through elongate slots in the body.

In another embodiment, the boss is rotatably mounted on the rail.

In a further embodiment, the work surface comprises a bottle support platform associated with the body for mounting below the body for receiving and positioning a bottle beneath the body for engagement by the worm screw.

In another embodiment, the lever arm, when in a fully raised position, is operable to release the locking means to allow sliding of the body on the rail.

conveniently, a lower end of the body has a bottle neck embracing mouth of frusto-conical shape to accommodate and centre bottle necks of different diameter at a lower end of the body.

BRIEF DESCRIPTION OF THE DRAWINGS

The invention will be more clearly understood from the following description of an embodiment thereof, given by way of example only with reference to the accompanying drawings in which.

DESCRIPTION OF THE PREFERRED EMBODIMENTS

Figure 2:
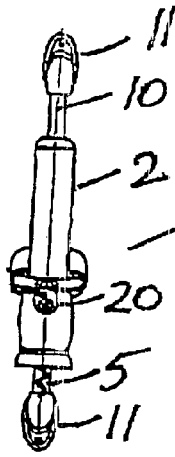
FIG. 2 is a front elevational view of the corkscrew assembly of FIG. 1 to a different scale.
Figure 1:
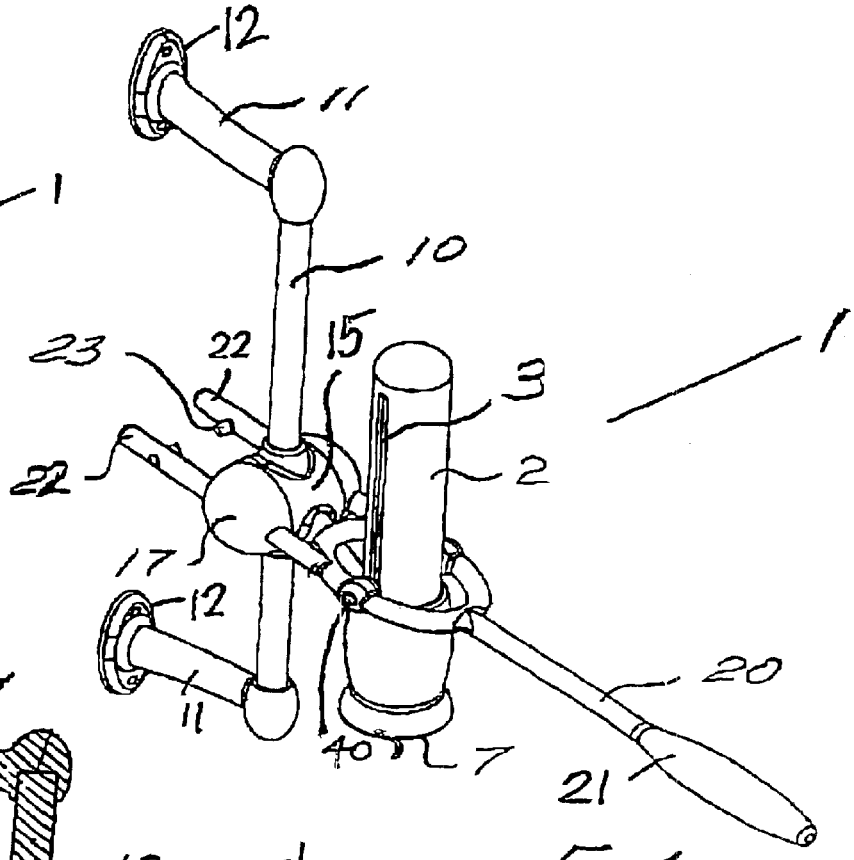
FIG. 1 is a prospective view of a corkscrew assembly according to the invention.
Figure 3:
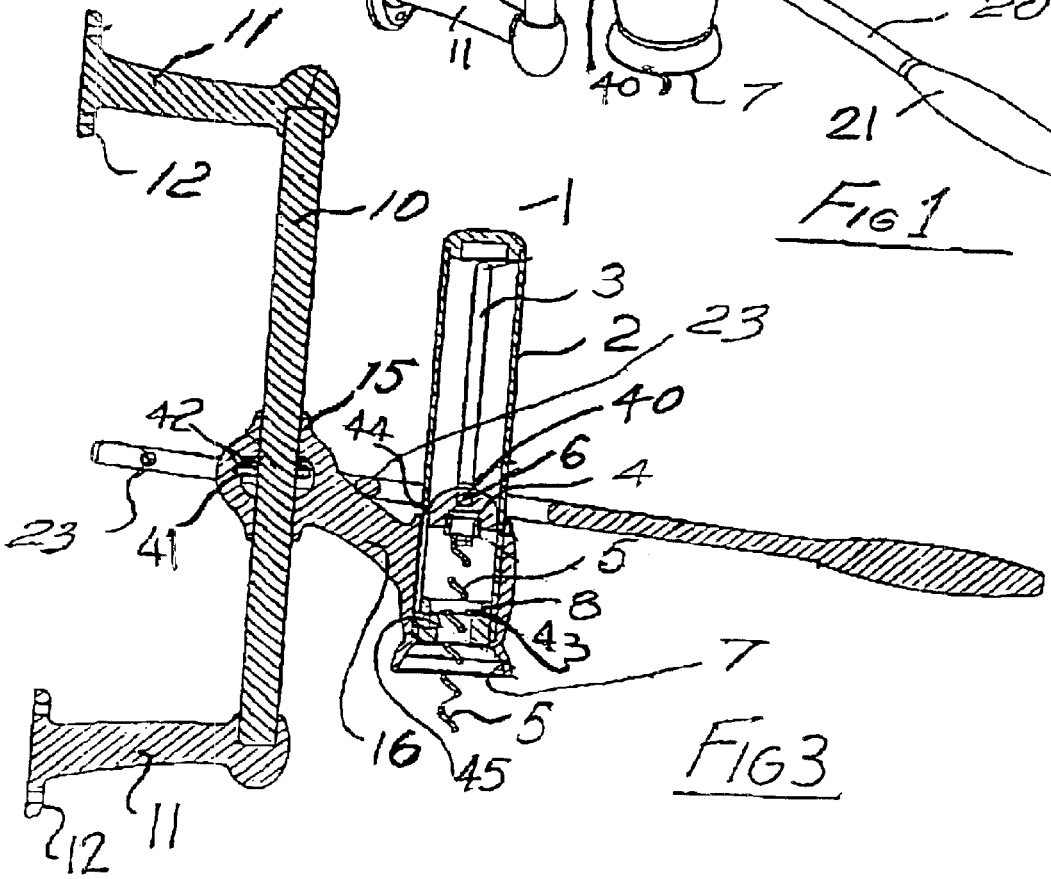
FIG. 3 is a sectional side elevational view of the corkscrew assembly.

Referring to the drawings, and initially to FIGS. 1 to 5 thereof, there is provided a corkscrew assembly indicated generally by the reference numeral 1 for mounting on a wall above a work surface (not shown). The corkscrew assembly 1 comprises a hollow body 2 having a pair of vertically arranged radially opposed through-slots 3. The hollow body 2 has a plug 4 slidably mounted therein, in turn rotatably mounting a spirally wound worm screw 5 which is rotatable about a longitudinal axis of the worm screw 5. The plug 4 has hole 6 which engages a dowel 40 which fits into a bifurcated lever arm 20 and rotates as the bifurcated arm 20 moves up and down. The worm screw 5 engages a complementary threaded guide 8 which is slidably mounted at a lower end of the body 2, the worm screw 5 being movable through the threaded guide 8 having a threaded bore 9 for rotation of the worm screw 5 about a longitudinal axis of the worm screw 5. The hollow body 2 has a bottle neck embracing mouth 7 of frusto-conical shape in cross section so as to accommodate different bottle neck diameters.

Figure 4:
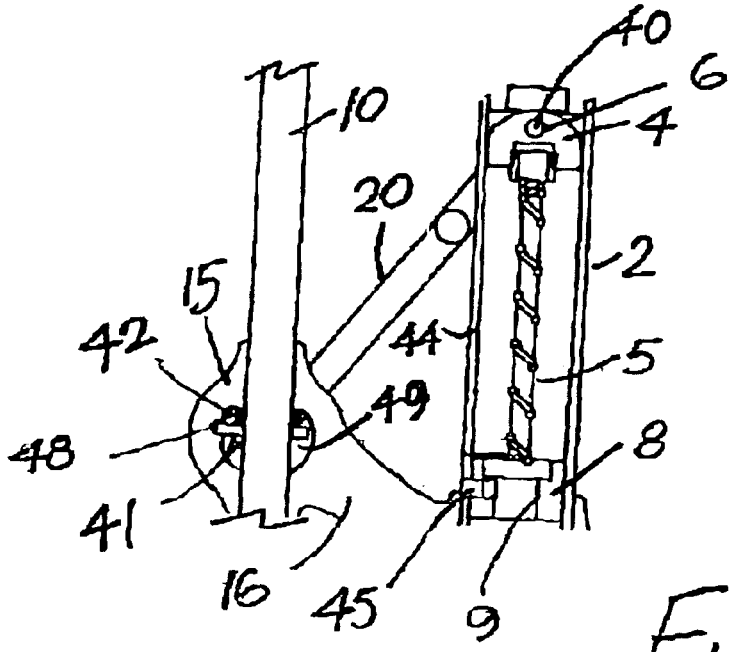
FIG. 4 is a detail sectional side elevational view of portion of the corkscrew assembly.
Figure 5:
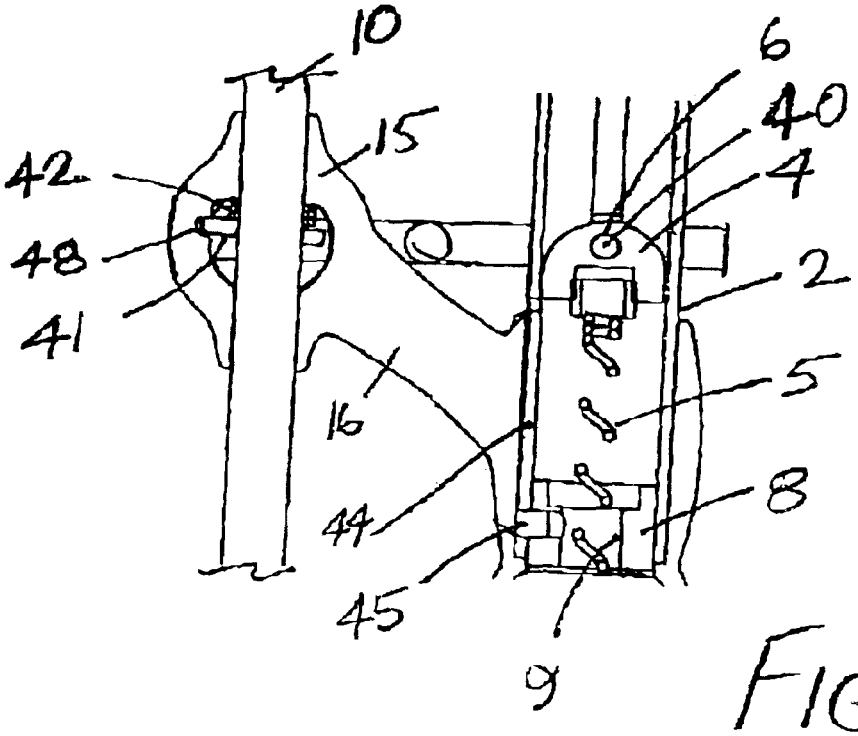
FIG. 5 is a view similar to FIG. 4, shown in another position of use.

A support for the corkscrew assembly 1 is provided by a vertically arranged slide rail formed by a bar 10 mounted onto pillars 11 each having a base plate 12 for mounting on a vertical support surface. On the bar 10 is mounted a carriage formed by the bored collar 15 which is directly connected to the hollow body 2 by a depending arm 16. The collar 15 has bosses 17 which are rotatably mounted on opposite sides of the collar 15. A bifurcated lever arm 20 has a handle 21 and a pair of forks 22 which slidably project through the bosses 17. Stops 23 on the forks 22 are used to move a locking washer 41 mounted within the collar 15 and engageable about the bar 10 against a spring 42 when the bifurcated lever arm 20 is in the uppermost position for alignment of a through hole of the washer 41 with the bar 10, as shown in FIG. 4, thus allowing the collar 15 and hence the corkscrew assembly 1 to slide up and down the bar 10. The locking washer 41 has a central through hole for through passage of the bar 10. A periphery of the washer 41 hingedly engages in an associated groove 48 in a side wall of a chamber 49 formed within the carriage 15 within which the locking washer 41 is mounted. When the lever arm 20 is lowered, the stops 23 disengage and the washer 41 is released and under the action of the spring 42, is inclined relative to the bar 10 pivoting about the groove 48 to lock the collar on the bar 10 as shown in FIG. 5.

In operation the bar 10 is mounted above a work surface at a desired height by the base plates 12. When it is desired to extract a cork from a bottle a bottle is placed adjacent the bar 10 and the body 2 is raised or lowered such that the mouth 7 engages and rests on the bottle neck with the screw 5 and thus the handle 21 pushed upwards. The collar 15 can be moved easily up and down the bar 10 to accommodate various heights of bottles and the weight of the arm 16, the hollow body 2 and bifurcated lever arm 20 will be such as to jam the collar 15 relative to the bar 10 thus the body 2 will be locked at the desired height. But disengaging the locking washer 41 as described above, will allow the collar 15 to be slid up and down on the bar 10. To extract a cork the lever handle 21 is pressed downwards so that the worm screw 5 is turned as it advances through the threaded guide 8 and rotates into and penetrates the cork. When the worm screw 5 is fully into the cork the handle 21 is raised and the cork will be raised out of the bottle which is still held securely in position on the work surface by the hollow body 2. As the bifurcated lever arm 20 continues its upward movement a dowel 45 which is fitted to the threaded guide 8 reaches the end of its upward travel in an associated lower slot 44 of the body 2. This stops the guide 8 and forces the worm screw 5 to turn in the reverse direction as it continues upwardly and at the same time the cork meets the bottom of the threaded guide 8 causing the cork to unscrew from the spirally wound worm screw 5.

Conveniently, when not in use, with the locking washer 41 disengaged by raising the lever arm 20, the body 2 can be rotated sidewardly against the wall into a stored position.

Figure 6:
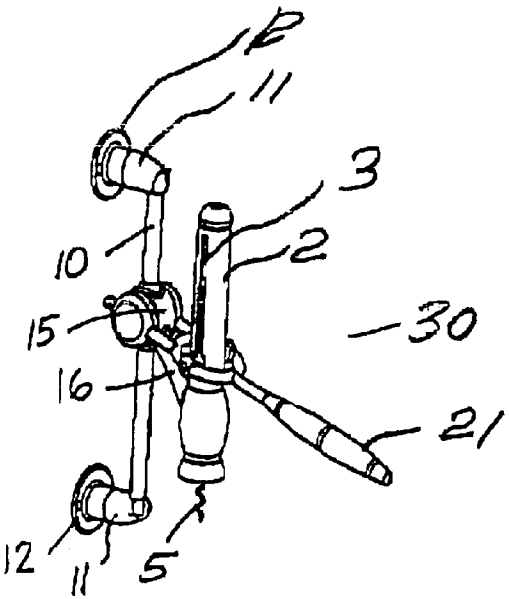
FIG. 6 is a perspective view of another corkscrew assembly.
Figure 6:
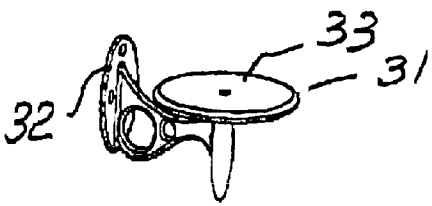
Figure 7:
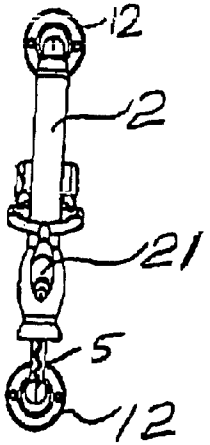
FIG. 7 is a front elevational view of the corkscrew assembly of FIG. 6.
Figure 7:
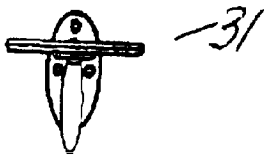
Figure 8:
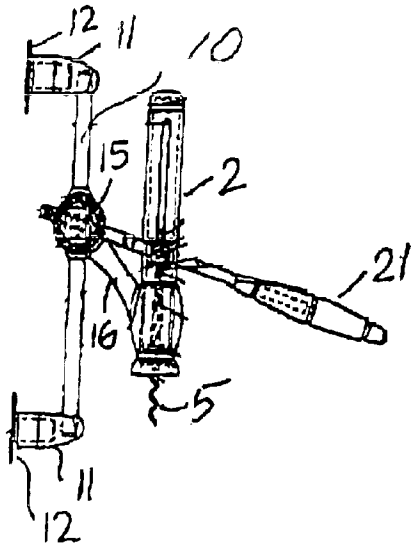
FIG. 8 is a side elevational view of the further corkscrew assembly of FIG. 6.
Figure 8:
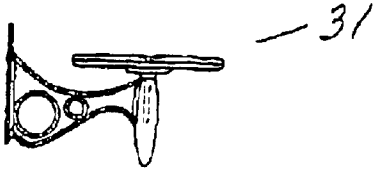
Figure 9:
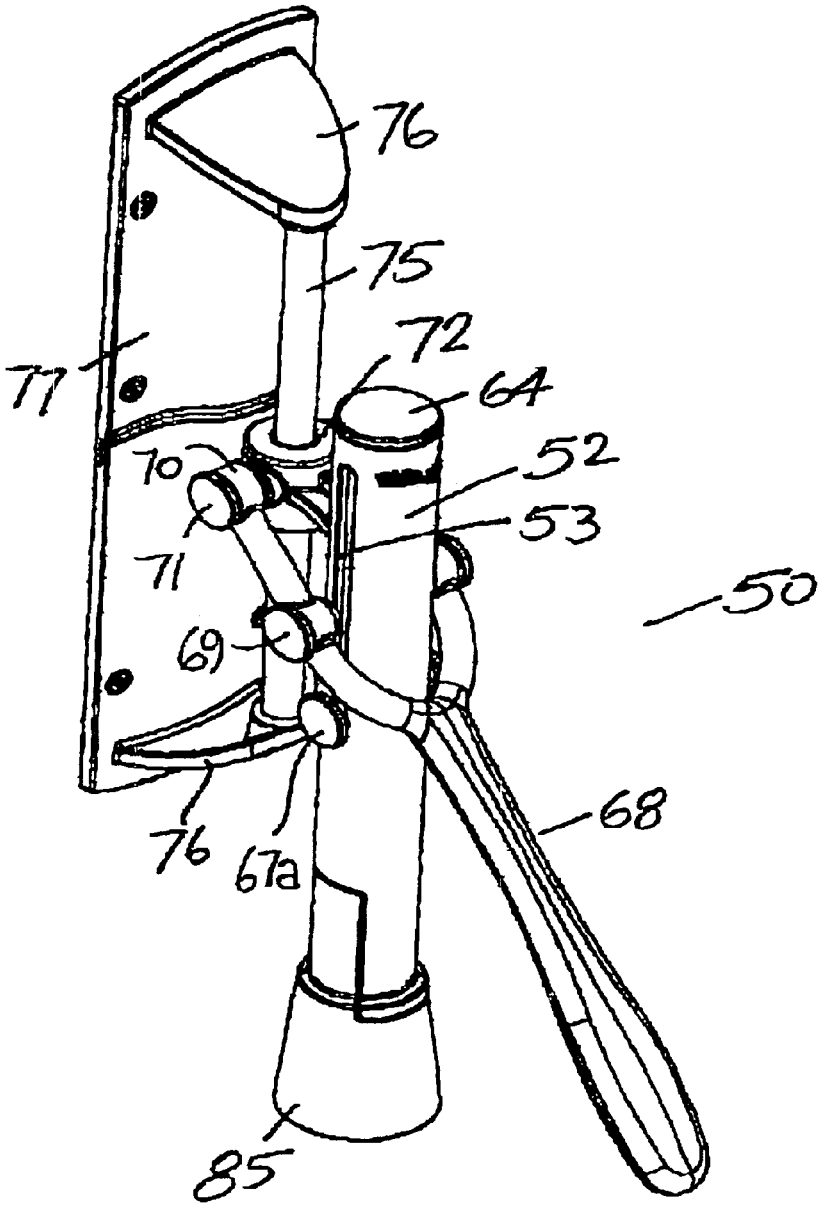
FIG. 9 is a perspective view of a further corkscrew assembly.
Figure 9:
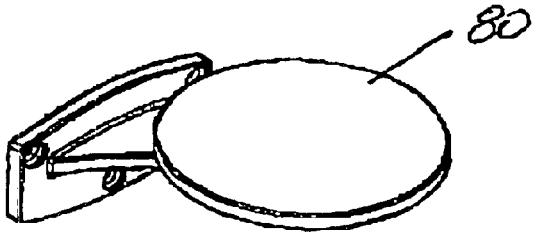
Figure 10:
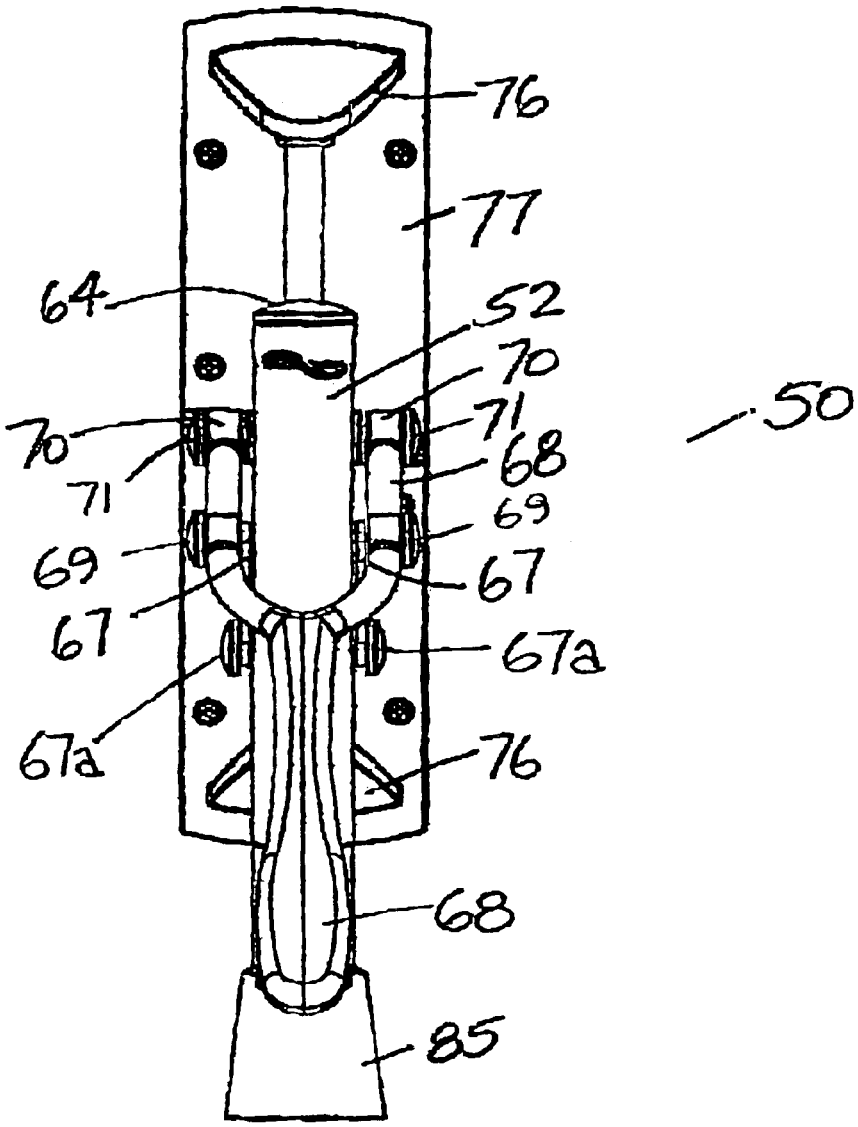
FIG. 10 is a front elevational view of the corkscrew assembly of FIG. 9.
Figure 10:
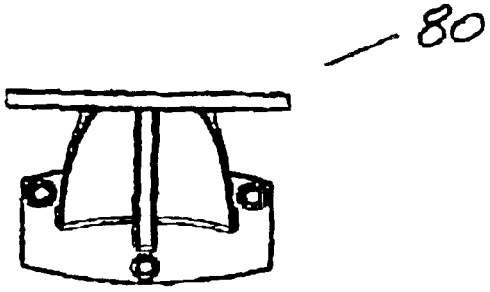
Figure 11:
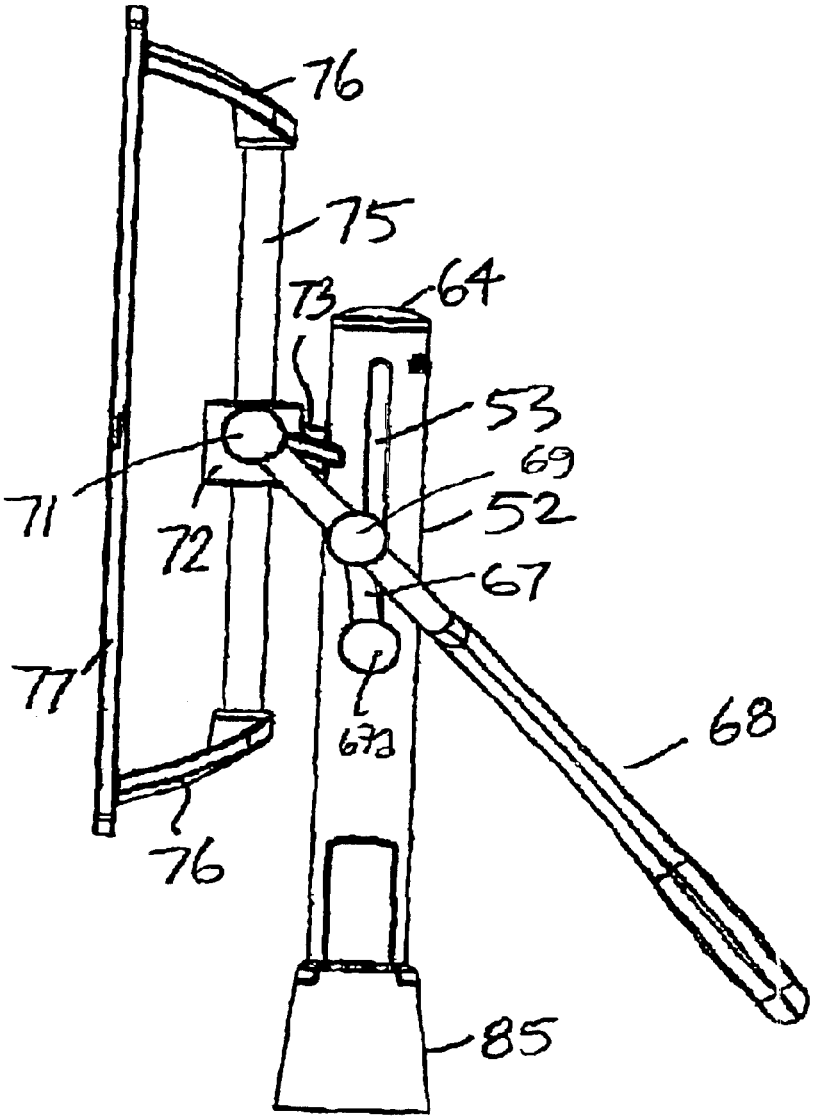
FIG. 11 is a side elevational view of the corkscrew assembly of FIG. 9.
Figure 11:
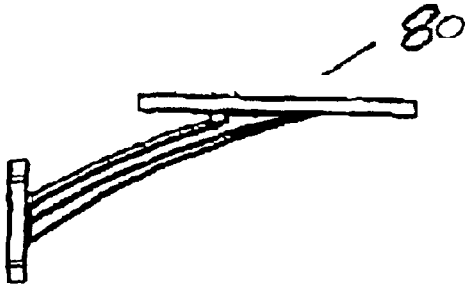
Figure 12:
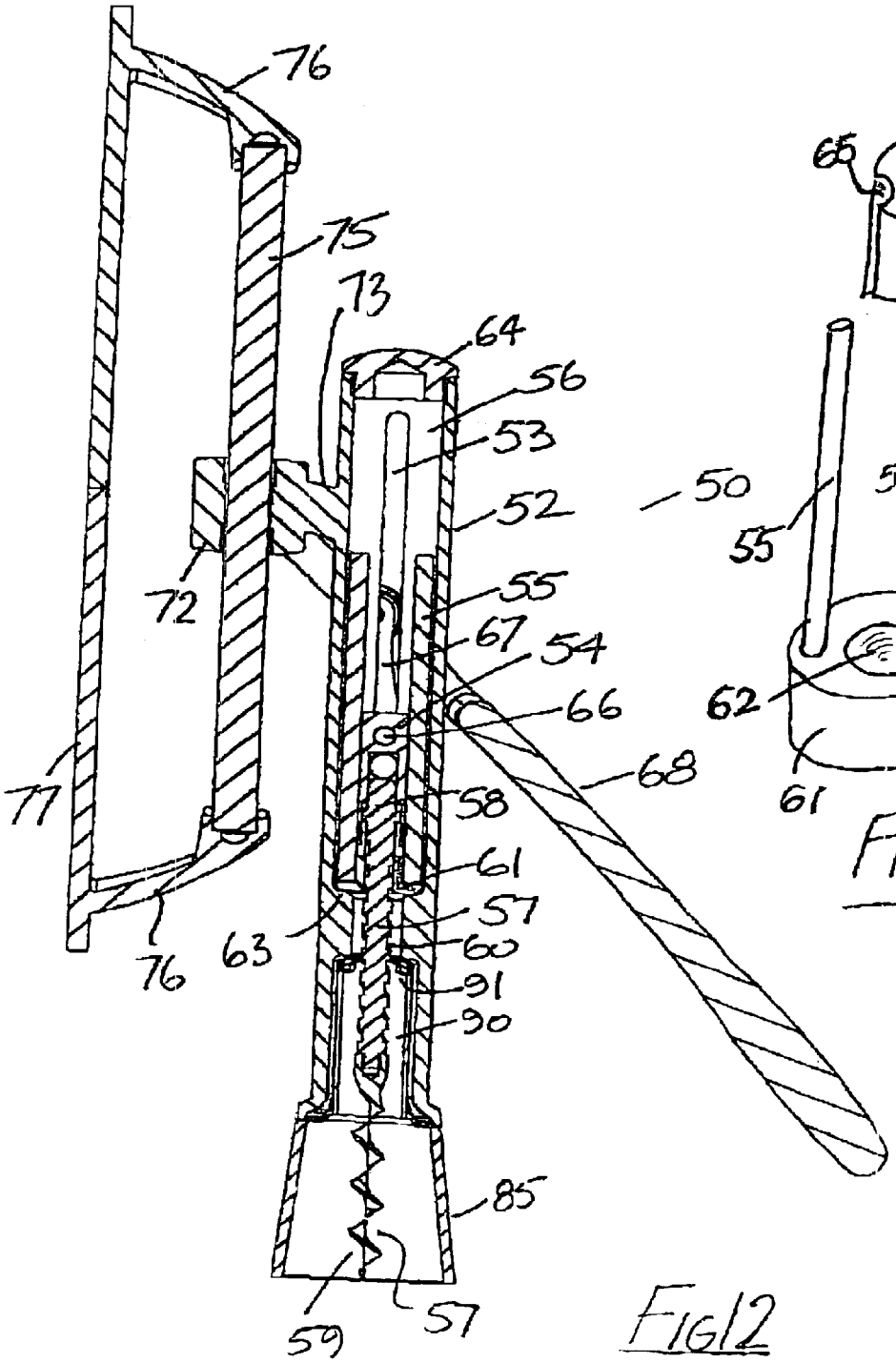
FIG. 12 is a side sectional elevational view of the corkscrew assembly of FIG. 9.
Figure 13:
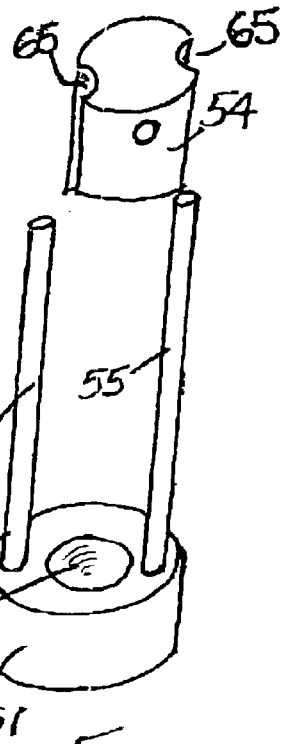
FIG. 13 is a detail perspective view showing portion of the corkscrew assembly of FIG. 9.

Referring to FIGS. 6, 7 and 8 there is illustrated an alternative construction of a corkscrew assembly indicated generally by the reference numeral 30 in which parts similar to those described with reference to the previous drawings are identified by the same reference numerals. In this embodiment there is provided a wall mounted bottle stand 31 having a base plate 32 for mounting on a wall and a bottle support 33 connected thereto.

Referring now to FIGS. 9 to 17, there is illustrated another corkscrew assembly, indicated generally by the reference numeral 50. The corkscrew assembly 50 comprises a hollow body 52 having a pair of vertically arranged, radially opposed through slots 53. Mounted within the body 2 is a plug or slide block 54 which is slidably mounted on guide rods 55 which in turn are mounted on a cylindrical threaded guide 61 which is slidably mounted within a cylindrical bore 56 of the body 52. Semi-circular grooves 65 on each side of the slide block 54 slidably engage with the guide rods 55. A corkscrew 57 has an upper end 58 which is rotatably mounted in the slide block 54 and a lower end 59 for engagement with a cork. A threaded shaft 60 of the worm screw 57 engages a complementary central threaded through hole 62 in the guide 61. It will be noted that the guide 61 is slidable within the body 52 between a lowered position against a step 63 in the bore 56 and a raised position in which the rods 55 engage against a cap 64 at a top of the body 52.

A pivot pin 66 mounted on the slide block 54 projects outwardly through the slots 53 in the side wall of the body 52 to engage pivot links 57 by pivot pins 67*a* and the links 67 are connected to a bifurcated lever arm 68 by pivot pins 69. The lever arm 68 has a bifurcated inner end 70 rotatably connected by pivots 71 to a collar 72 which is connected to the body 52 by a depending arm 73. The collar 72 forms a carriage which is vertically slidable on an associated slide bar 75 carried by pillars 76 attached to a base plate 77.

Figure 14:
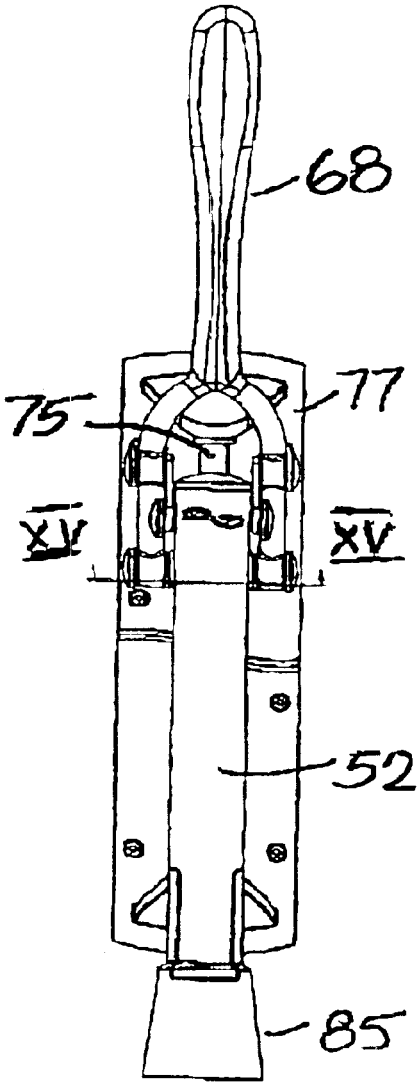
FIG. 14 is a front elevational view of the corkscrew of FIG. 9 with an actuating lever arm shown in a raised position.
Figure 15:
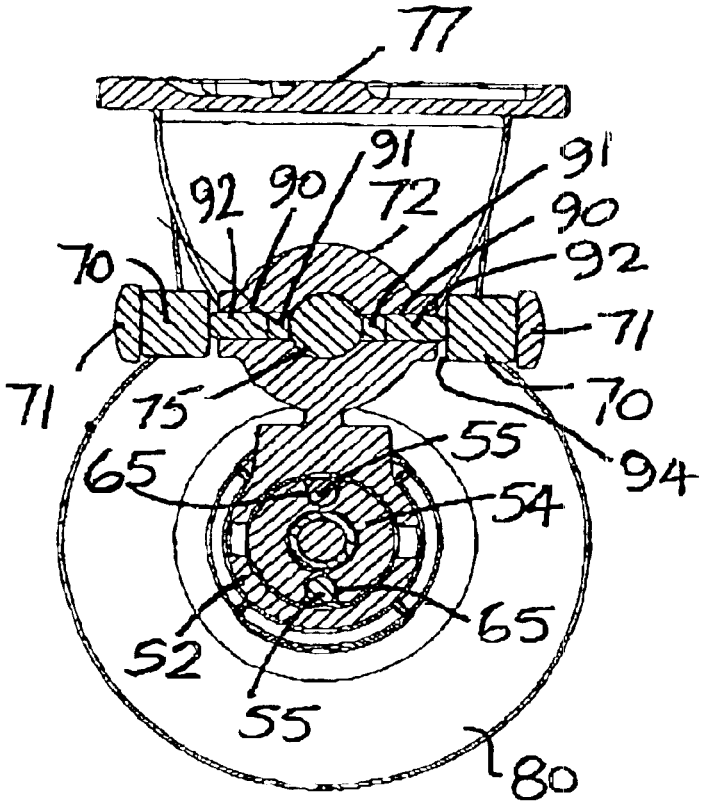
FIG. 15 is a sectional view taken along the line XV—XV of FIG. 14.
Figure 16:
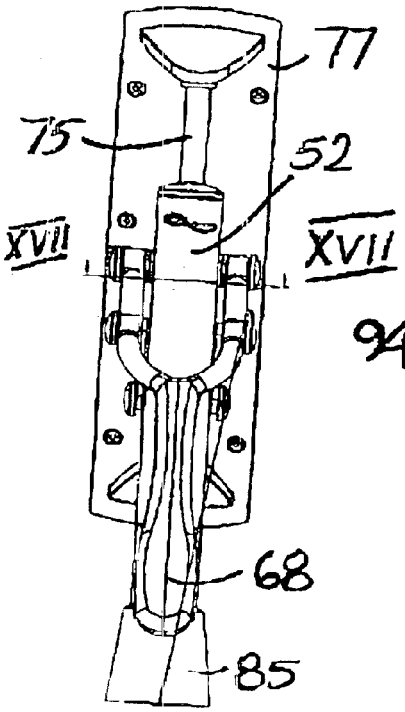
FIG. 16 is an elevational view of the corkscrew assembly of FIG. 9 with the actuating lever shown in a lowered position.
Figure 17:
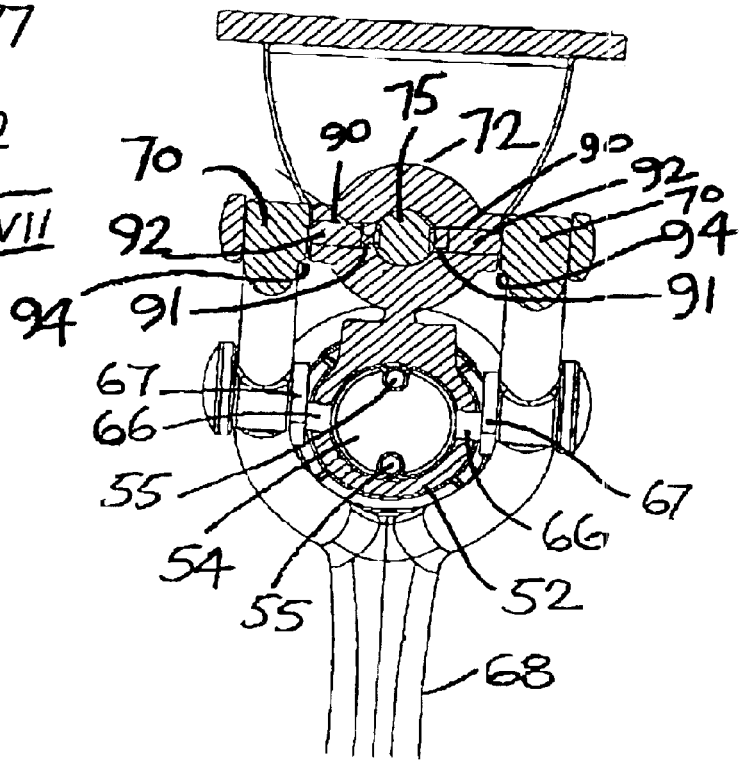
FIG. 17 is a sectional view taken along the lines XVII—XVII of FIG. 16.

Referring particularly to FIGS. 14 to 17, locking means for locking the collar 72 on the slide bar 75 will be described. The collar 72 has a pair of radial bores 90. At an inner end of each bore 90, there is provided a rubber brake plug 91. A cam follower rod 92 is slidably mounted within each bore 90 outboard of the rubber plug 91 and has an outer end which projects outwardly of the bore 90 for engagement with an associated cam 94 at the inner end 70 of the lever arm 68. Thus, when the lever arm 68 is fully raised, as shown in FIGS. 14 and 15, there is no pressure exerted by the inner end 70 of the lever arm 68 on the followers 92 and plugs 91 and thus the brake is released and the collar 72 can slide up and down on the slide bar 75. However, as soon as the lever arm 68 is lowered downwardly from the fully raised position, the cams 94 engage the followers 92 which are pushed inwardly to compress the rubber plugs 91 against the slide bar 75 to brake and hold the collar 72 on the slide bar 75.

A bottom support platform 80 is provided for mounting below the body 52 for receiving and positioning a bottle beneath the body 52 for engagement by the worm screw 57.

A lower end of the body 52 has a bottle neck embracing mouth 85 of frusto-conical shape to accommodate different bottle neck diameters.

In use, a bottle is mounted on the platform 80, and with the lever arm 68 in a raised position, the body 52 is moved vertically on the bar 75 to engage the mouth 85 at a lower end of the body 52 with the neck of the bottle. The lever arm 68 is then pivoted downwardly engaging the brake and the worm screw 57 is turned by the threaded guide 61 and rotates into and penetrates the cork in the bottle neck. The lever arm 68 is then raised and the cork will be pulled out of the bottle into a cork receiving chamber 90 in the body 52 above the mouth 85, the slide block 54 and guide 61 sliding together upwardly within the bore 56 of the body 52. When the cork is fully extracted from the bottle, upper ends of the guide rods 55 will engage the cover 64 at a top of the body 52 halting the guide 61. Further upward movement of the lever arm 68 causes the slide block 54 to slide upwardly along the guide rods 55 thus causing reverse rotation of the worm screw 57 to disengage the worm screw 57 from the cork which engages against an inner end 91 of the chamber 90. Thus, it will be appreciated that the cork is removed from the bottle and then removed from the worm screw in the single upward movement of the lever arm 68.

It is envisaged that other height adjustment means may be employed within the bore collar to engage with a bar. For example, a spring-loaded rubber bushing may be used. Pins or spring-loaded pins or even a threaded knob may be employed to locate the corkscrew mechanism in place. Indeed there are many location and or securing devices which would be suitable for this purpose.

While it is preferable that the slide bar 75 is of circular section so that the body 52 may be pivoted to one side for neat storage against a wall on which it is mounted, the slide bar 75 need not necessarily be circular and other configurations could be used. It is also envisaged that the sliding of the body on the slide rail may be provided either with or without braking. It may be possible, by making the collar a loose fit on the slide bar 75, that this would provide self-clamping when the corkscrew is engaged, effectively tilting and locking the collar on the slide bar. It is also envisaged that additional gripping means for gripping the bottle and preventing turning of the bottle during operation of the corkscrew may be provided either within the mouth 85 by means of a rubber washer or the like, or on the support surface or platform on which the bottle is rested during operation of the corkscrew, providing such surface with a friction enhancing finish or material cover.

In the specification the terms "comprise, comprises, comprised and comprising" or any variation thereof and the terms "include, includes included and including" or any variation thereof are considered to be totally interchangeable and they should all be afforded the widest possible interpretation and vice versa.

The invention is not limited to the embodiment hereinbefore described, but may be varied in both construction and detail within the scope of the appended claims.

What is claimed is:

1. A corkscrew assembly comprising:

a body;

a support for the body comprising a slide rail;

a carriage slidable along the slide rail and mounting the body which is height adjustable relative to a work surface;

a worm screw rotationally mounted on the body;

locking means on the carriage comprising a brake element for engagement with the slide rail; and a lever arm for moving the brake element between a released inoperative position and an engaged operative braking position, the lever arm also serving to operate the worm screw.

2. A corkscrew as claimed in claim 1, wherein the lever arm when in a fully raised position releases the brake element and when moved downwardly away from the fully raised position engages the brake element for locking the carriage on the slide rail.

3. A corkscrew as claimed in claim 2, wherein the brake element is slidably mounted on the carriage and has an inner end for engagement with the slide rail and an outer end which is engageable by an associated cam on the lever arm to urge the brake element against the slide rail in the engaged position.

4. A corkscrew as claimed in claim 3, wherein the brake element comprises a friction plug mounted in a bore on the carriage, a cam follower rod slidably mounted in the bore outboard of the friction plug and having an outer end which projects outwardly of the bore for engagement with the cam on the lever arm.

5. A corkscrew as claimed in claim 1, wherein a pair of brake elements are provided on the carriage for clamping the slide rail therebetween in response to operation of the lever arm.

6. A corkscrew as claimed in claim 1, wherein the brake element comprises a locking washer mounted on the carriage and having a central through hole for through passage of the slide rail, a periphery of the washer hingedly engaging the carriage at one side of the washer.

7. A corkscrew as claimed in claim 1, wherein the carriage is a loose sliding fit on the slide rail.

8. A corkscrew as claimed in claim 1, wherein the slide rail is of circular section and the carriage comprises a collar having a central through hole for sliding engagement with the rail.

9. A corkscrew as claimed in claim 1, wherein the worm screw is rotatably mounted on a slide block for rotation about a longitudinal axis of the worm screw, the slide block being slidably mounted on the body for vertical movement, the worm screw engaging a complementary threaded guide mounted on the body and being movable through the threaded guide causing rotation of the worm screw.

10. A corkscrew as claimed in claim 9, wherein the complementary threaded guide is slidably mounted on the body for movement along a shorter path than the slide block engaging the worm screw.

11. A corkscrew as claimed in claim 9, wherein the lever arm is bifurcated having an inner end which is rotatably mounted on the carriage, the lever arm being connected intermediate its ends to the slide block carrying the worm screw.

12. A corkscrew as claimed in claim 11, wherein the body is of tubular construction, the slide block being slidable within a bore of the body and the lever arm is connected to the slide block through elongate slots in the body.

13. A corkscrew as claimed in claim 1, wherein the carriage is rotatably mounted on the rail.

14. A corkscrew assembly as claimed in claim 1, wherein the work surface comprises a bottle support platform associated with the body for mounting below the body for receiving and positioning a bottle beneath the body for engagement by the worm screw.

15. A corkscrew as claimed in claim 1, wherein a lower end of the body has a bottle neck embracing mouth of frusto-conical shape to accommodate and centre bottle necks of different diameter at a lower end of the body.

16. A corkscrew assembly comprising:

a body;

a support for the body comprising a slide rail;

a carriage slidable along the slide rail and mounting the body which is height adjustable relative to a work surface;

a worm screw rotationally mounted on the body;

locking means on the carriage comprising a brake element for engagement with the slide rail; and a lever arm for moving the brake element between a released inoperative position and an engaged operative braking position, the brake element having an inner end for engagement with the slide rail and an outer end which is engageable by an associated cam on the lever arm to urge the brake element against the slide rail in the engaged position, the lever arm also serving to operate the worm screw.

17. A corkscrew assembly as claimed in claim 16, wherein the brake element comprises a friction plug mounted in a bore on the carriage, a cam follower rod slidably mounted in the bore outboard of the friction plug and having an outer end which projects outwardly of the bore for engagement with the cam on the lever arm.

18. A corkscrew assembly comprising:

a body;

a support for the body comprising a slide rail;

a carriage slidable along the slide rail and mounting the body which is height adjustable relative to a work surface;

a worm screw rotationally mounted on the body;

locking means on the carriage comprising a brake element for engagement with the slide rail; and a lever arm for moving the brake element between a released inoperative position and an engaged operative braking position, the brake element comprising a locking washer mounted on the carriage and having a central through hole for through passage of the slide rail, a periphery of the washer hingedly engaging the carriage at one side of the washer, the lever arm also serving to operate the worm screw.

* * * * *